US005119874A

United States Patent [19]

Ferguson et al.

[11] Patent Number: 5,119,874

[45] Date of Patent: * Jun. 9, 1992

[54] SWAB CUP AND SWAB ASSEMBLY

[76] Inventors: Fred S. Ferguson, 23434 Wintergate Dr., Spring, Tex. 77373; Lonnie K. Perry, P.O. Box 1415, Hobbs, N. Mex. 88240

[ * ] Notice: The portion of the term of this patent subsequent to Jul. 10, 2007 has been disclaimed.

[21] Appl. No.: 549,743

[22] Filed: Jul. 9, 1990

Related U.S. Application Data

[63] Continuation-in-part of Ser. No. 383,005, Jul. 21, 1989, Pat. No. 4,940,092.

[51] Int. Cl.[5] ..... E21B 37/00

[52] U.S. Cl. ..... 166/105.2; 166/105.3; 166/105.4; 166/173; 166/177

[58] Field of Search ..... 166/311, 105.1, 105.2, 166/105.3, 105.4, 173, 177, 153

[56] References Cited

U.S. PATENT DOCUMENTS

| | | | |
|---|---|---|---|
| 3,343,137 | 4/1969 | Scott | 166/153 X |
| 4,392,528 | 7/1983 | Paulson | 166/177 X |
| 4,940,092 | 7/1990 | Ferguson et al. | 166/311 |

*Primary Examiner*—William P. Neuder
*Attorney, Agent, or Firm*—Kenneth A. Roddy

[57] ABSTRACT

A swab assembly for use within a pump barrel includes a longitudinal swab bypass mandrel which has a top end connectable to a reciprocating member and at least one longitudinal bypass channel on its circumference and axially spaced stop shoulders at each end of the bypass channel with a smooth sealing portion between the bottom end of the bypass channel and the lower stop shoulder. At least one swab cup is slidable vertically on the bypass mandrel between an uppermost fluid bypass position and a lowermost fluid lifting position. The swab cup has a generally cylindrical outer body formed of flexible resilient material surrounding a tubular metal sleeve and has a central longitudinal bore coaxial with the bore of the sleeve. The cup body has an upper portion extending beyond the top end of the sleeve and a lower portion extending below the bottom end of the sleeve. The mandrel upper stop shoulder forms a stop for the swab cup in its uppermost position and the lower stop shoulder forms a stop for the swab cup in its lowermost lifting position. The swab cup interior diameter allows fluid circulation through the mandrel bypass channel in the uppermost position and in the lowermost lifting position forms a fluid sealing relation on the bypass mandrel sealing portion to close off circulation through the bypass channel. The upper portion of the swab cup forms a sliding fluid sealing relation with the interior surface of the pump barrel.

6 Claims, 2 Drawing Sheets

SWAB CUP AND SWAB ASSEMBLY

CROSS REFERENCE TO RELATED APPLICATION

This application is a continuation-in-part of co-pending application Ser. No. 07/383,005 filing date Jul. 21, 1989 now U.S. Pat. No. 4,940,092.

BACKGROUND OF THE INVENTION

1. FIELD OF THE INVENTION

This invention relates generally to well swab devices, and more particularly to a swab cup and swab assembly for use within a pump barrel wherein at least one swab cup is slidably mounted on a longitudinal swab bypass mandrel having at least one longitudinal bypass channel on its circumference and axially spaced stop shoulders at each end of the bypass channel.

2. BRIEF DESCRIPTION OF THE PRIOR ART

Sand pumps and cleanout tools which remove sand and debris from wells are known in the art. Most sand pumps and cleanout tools utilize some type of reciprocating swab or sealing device to aid returning pumped fluids to the well or to remove it entirely from the well by pumping it to the surface. There are several patents which disclose various cleanout tools and downhole pump apparatus having swab devices or reciprocating seals.

McFarlane, U.S. Pat. No. 2,224,916 discloses a well swab having a cruciform cross sectioned mandrel with vertical channels and a shoulder at each end. The mandrel is installed above a check valve which has a port communicating with the channels. A swab sleeve having a metal liner and a rubber exterior packer slides on the mandrel and seats at the lower end to close the port.

Read, U.S. Pat. No. 3,352,212 discloses well swab sealing devices having a plurality of upwardly facing unreinforced rings or flanges molded in spaced relationship about a metal tubular support, and are arranged to flex downwardly under a load of fluid and to flex further downward under a predetermined load of fluid to allow the by-pass of fluid about the edges of the flexible sealing flanges to dump the excess load.

Hamrick, U.S. Pat. No. 4,407,360 discloses a water pump which utilizes an inflatable packer and a conical sand trap.

Moody et al, U.S. Pat. No. 4,421,182 discloses a hydraulic clean-out and drilling tool. The lower assembly includes a debris chamber and a flapper trap valve.

Caldwell, U.S. Pat. No. 4,478,285 and U.S. Pat. No. 4,711,299 disclose apparatus for removing debris which include a hollow piston with a splined piston rod keyed to the pumping portion to transmit rotary motion to the lower debris retaining portion. A hollow piston head includes a ball valve to prevent downward flow of fluid. Liquid debris is passed through the interior of the piston and into the upper portion of the apparatus. The upper portion of the apparatus selectively receives a ported sub for recirculating the liquid back into the well or an unported sub which prevents return of the debris to the well.

Williams et al, U.S. Pat. No. 4,493,383 discloses a well clean out tool utilizing an inverted modified Bowen bumper sub which includes a piston with a hollow hexagonal piston tube plugged at the upper end and keyed to the pumping sub to transmit rotary motion to the lower debris retaining portion. The piston includes a valve to control flow of fluid into the bore of the piston and piston tube and a plurality of unrestricted openings through the hollow wall of the piston and closely adjacent to the valve.

The present invention is distinguished over the prior art in general, and these patents in particular by a swab assembly for use within a pump barrel which includes a longitudinal swab bypass mandrel having a top end connectable to a reciprocating member and at least one longitudinal bypass channel on its circumference and axially spaced stop shoulders at each end of the bypass channel with a smooth sealing portion between the bottom end of the bypass channel and the lower stop shoulder. At least one swab cup is slidable vertically on the bypass mandrel between an uppermost fluid bypass position and a lowermost fluid lifting position. The swab cup has a generally cylindrical outer body formed of flexible resilient material surrounding a tubular metal sleeve and has a central longitudinal bore coaxial with the bore of the sleeve. The cup body has an upper portion extending beyond the top end of the sleeve and a lower portion extending below the bottom end of the sleeve. The mandrel upper stop shoulder forms a stop for the swab cup in its uppermost position and the lower stop shoulder forms a stop for the swab cup in its lowermost lifting position. The swab cup interior diameter allows fluid circulation through the mandrel bypass channel in the uppermost position and in the lowermost lifting position forms a fluid sealing relation on the bypass mandrel sealing portion to close off circulation through the bypass channel. The upper portion of the swab cup forms a sliding fluid sealing relation with the interior surface of the pump barrel.

SUMMARY OF THE INVENTION

It is therefore an object of the present invention to provide a swab cup and swab assembly which will effectively aid in removing fluid from a well bore.

It is another object of this invention to provide a swab cup and swab assembly wherein swab cups are slidably mounted on a swab bypass mandrel.

Another object of this invention is to provide a swab cup and swab assembly wherein swab cups slidably mounted on a swab bypass mandrel having bypass channels form a sealing relation with the interior of a pump barrel and allow fluids to be circulated through the interior of the swab cups to the exterior of the pump barrel.

Another object of this invention is to provide a swab assembly having a longitudinal swab bypass mandrel adapted for connection to a reciprocating member and which has at least one longitudinal bypass channel on its circumference and axially spaced stop shoulders at each end of the bypass channel.

Another object of this invention is to provide a swab assembly including a longitudinal swab bypass mandrel having at least one longitudinal bypass channel on its circumference with axially spaced stop shoulders at each end of the bypass channel and at least one swab cup member slidable vertically on the bypass mandrel between an uppermost fluid bypass position and a lowermost fluid lifting position.

A further object of this invention is to provide a swab cup for use within a tubular pump barrel which has a tubular metal sleeve within a cylindrical outer body of flexible resilient material wherein the upper portion of the outer body is sufficiently flexible to flex outwardly when pulled upwardly through a fluid and flex inwardly when pushed downwardly through a fluid.

A still further object of this invention is to provide a downhole well clean out tool which is simple in construction, economical to manufacture, and rugged and reliable in use.

Other objects of the invention will become apparent from time to time throughout the specification and claims as hereinafter related.

The above noted objects and other objects of the invention are accomplished by a swab assembly for use within a pump barrel which includes a longitudinal swab bypass mandrel having a top end connectable to a reciprocating member and at least one longitudinal bypass channel on its circumference and axially spaced stop shoulders at each end of the bypass channel with a smooth sealing portion between the bottom end of the bypass channel and the lower stop shoulder. At least one swab cup is slidable vertically on the bypass mandrel between an uppermost fluid bypass position and a lowermost fluid lifting position. The swab cup has a generally cylindrical outer body formed of flexible resilient material surrounding a tubular metal sleeve and has a central longitudinal bore coaxial with the bore of the sleeve. The cup body has an upper portion extending beyond the top end of the sleeve and a lower portion extending below the bottom end of the sleeve. The mandrel upper stop shoulder forms a stop for the swab cup in its uppermost position and the lower stop shoulder forms a stop for the swab cup in its lowermost lifting position. The swab cup interior diameter allows fluid circulation through the mandrel bypass channel in the uppermost position and in the lowermost lifting position forms a fluid sealing relation on the bypass mandrel sealing portion to close off circulation through the bypass channel. The upper portion of the swab cup forms a sliding fluid sealing relation with the interior surface of the pump barrel.

DESCRIPTION OF THE PREFERRED EMBODIMENT

Figure 1:
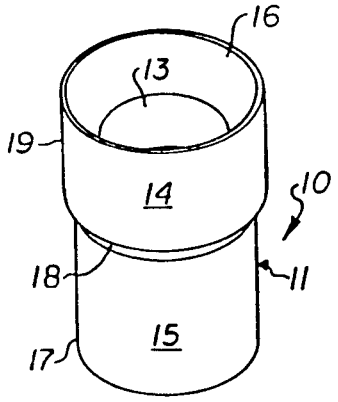
FIG. 1 is an isometric view of a swab cup in accordance with the present invention.
Figure 2:
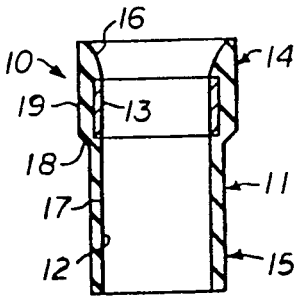
FIG. 2 is a longitudinal cross section through the swab cup member of FIG. 1.
Figure 6:
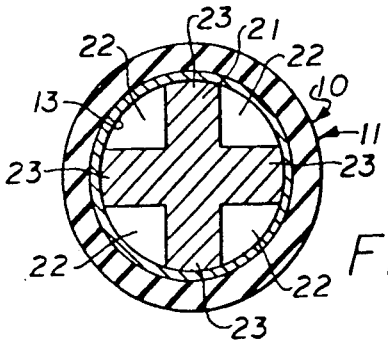
FIG. 6 is a transverse cross section through the swab assembly taken along line 6—6 of FIG. 4.

Referring to the drawings by numerals of reference, there is shown in FIGS. 1 and 2, a preferred swab cup member 10 in accordance with the present invention The swab cup 10 has a generally cylindrical outer body 11 formed of Neoprene, or other suitable rubber or elastomeric material. The outer body 11 has a central bore 12 with an internal metallic sleeve 13 disposed centrally within the bore. The outer body 11 has an upper portion 14 extending beyond the top end of the sleeve 13 and a lower portion 15 extending below the bottom end of the sleeve. The interior of the outer body upper portion 14 extends upward and outward above the top end of the sleeve 13 as indicated at 16.

The exterior of the outer body has a first exterior diameter 17 extending upwardly a distance from the bottom end, an intermediate portion 18 extending angularly upward and outward therefrom and a second diameter 19 larger than the first diameter 17 extending upwardly from the intermediate portion 18. The upper portion 14 of the outer body is sufficiently flexible to flex outwardly when pulled upwardly through a fluid and flex inwardly when pushed downwardly through a fluid, as explained hereinafter.

Figure 3:
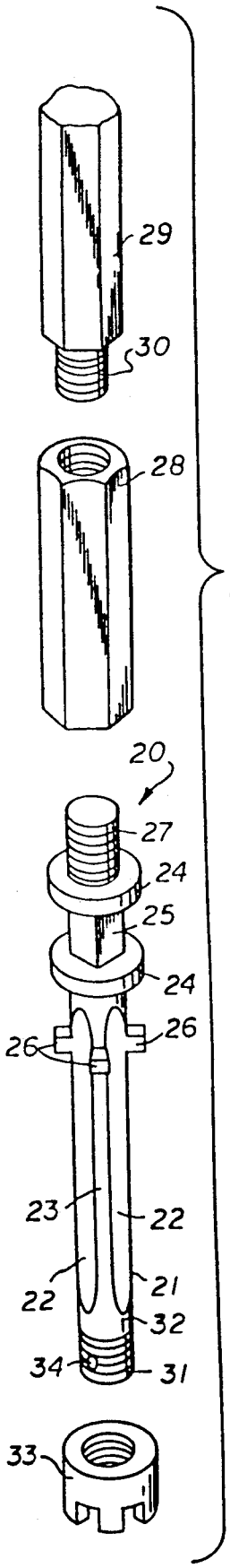
FIG. 3 is an exploded isometric view of the swab assembly including a bypass mandrel in accordance with the present invention.

Referring now to FIG. 3, there is shown a swab assembly 20 upon which one or more of the swab cups 10 are to be slidably mounted. The swab assembly 20 comprises a swab bypass mandrel 21 cruciform in cross section to form longitudinal channels or passages 22 on its outer surface separated by longitudinally extending ribs 23. A pair of radial flanges 24 are formed on the upper end of the mandrel 21 and are spaced longitudinally apart by a wrench flat portion 25. A short distance below the lowermost flange 24, the rib portions 23 extend radially outwardly to form a series of circumferentially spaced stop shoulders 26.

The top end of the bypass mandrel 21 above the top radial flange 24 has a pin thread 27. A hexagonal knocker nut 28 threadedly connects the top end of the bypass mandrel 21 to a hexagonal pump mandrel 29. The knocker nut 28 is internally threaded at its top and bottom ends whereby the top end of the knocker nut is threadedly received on threads 30 on the bottom of the pump mandrel 29 and its bottom end is threadedly received on the pin threads 27 of the swab bypass mandrel 21. The hexagonal pump mandrel 29 extends through the top cap of a pump barrel, described hereinafter.

The bottom end of the swab bypass mandrel 21 has external threads 31 which terminate below the longitudinal channels 22 to leave a smooth cylindrical portion or sealing surface 32 on the exterior of the bypass mandrel below the channels.

Figure 4:
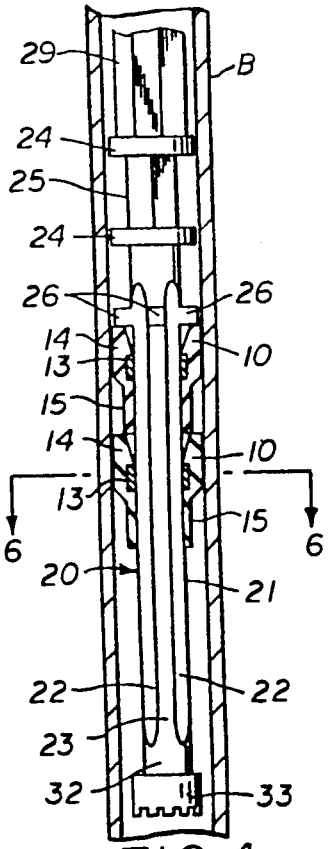
FIG. 4 is a partial cross section of the swab bypass mandrel with the swab cups in the down stroke position.
Figure 5:
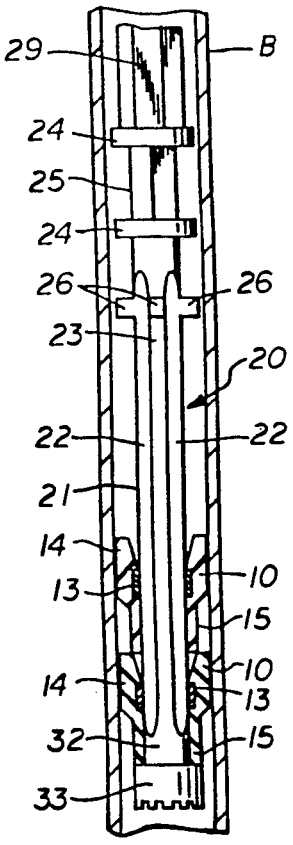
FIG. 5 is a partial cross section of the swab bypass mandrel with the swab cups in the up stroke position.
Figure 7:
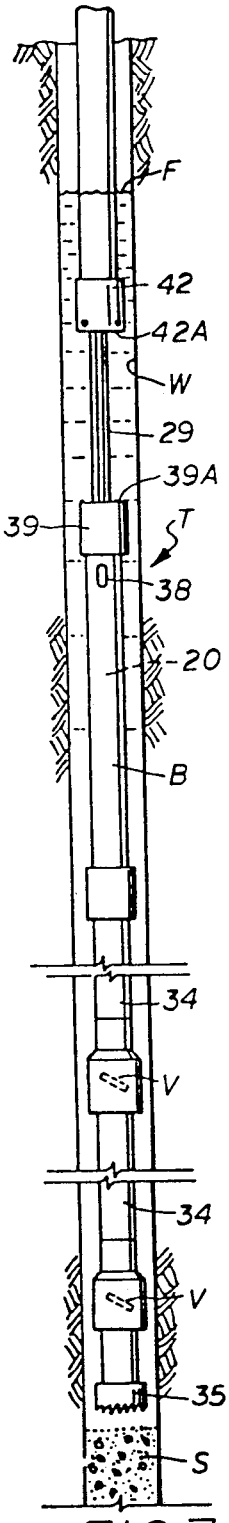
FIG. 7 is a schematic side elevation of a well clean out tool including a swab assembly in accordance with the present invention within a well bore.

As seen in FIGS 4 and 5, one or more of the swab cups 10 are slidably received on the bypass mandrel 21. The interior of the lower portion 15 of the swab cup 10 surrounds the bypass mandrel 21 and the exterior diameter 17 of the lower portion 15 is spaced radially inward from the interior of the side wall of the pump barrel B. The enlarged exterior diameter 19 of the upper portion 14 is of sufficient diameter to slidably engage the interior of the side wall of the pump barrel B. The top surface of the swab cup 10 will engage the stop shoulders 26 of the bypass mandrel. The cross sectional thickness of the swab cup 10 is such that the enlarged diameter upper portion 14 will flex outwardly to form a sealing relation with the pump barrel interior on the up stroke and will flex inwardly on the down stroke to slide relative to the pump barrel interior.

A castle nut 33 is threadedly received on the threads 31 at the bottom end of the bypass mandrel 21 and after the swab cup(s) are installed is secured thereon with a cotter pin (not shown) installed in a transverse hole 34 extending through the threaded portion 31. The castle nut 33 serves as a bottom stop for the swab cup(s) 10. In this manner, the swab cup 10 or cups are captured between the stop shoulders 26 at the top end and the castle nut 33 at the bottom end of the bypass mandrel 21.

Referring now to FIGS. 7-10, the swab assembly 20 is shown within a pump barrel B installed in a downhole cleanout tool assembly T within a well bore W. The pumping portion of the tool T is installed in a drill string above one or more debris-receiving and trapping subs or "saver subs" 34 having valve means V at the bottom end, such as conventional flapper or check valves. The well bore W has sand and other matter S at the bottom and is partially filled with a column of fluid F. The debris-receiving and trapping subs or "saver subs" 34 are used to catch and retain sand, debris, metal bits, etc., suctioned up by the pump as explained hereinafter. A mule shoe sub, notched collar, drag bit, mill, or other suitable penetrating device 35 may be installed at the bottom of the lower saver sub 34 to break up, stir, or penetrate sand and debris at the bottom of the well.

The valves V are of conventional check valve or flapper valve design having a hinged flapper element slightly smaller in diameter than the interior diameter of the housing in which it is hingedly mounted and a valve disposed below the flapper element to sealingly engage the flapper in its seated position. The valves V are operated when the pump is stroked upward and the suction inside the recovery or trapping subs 34 (below the pumping portion) lifts the flapper elements off their seats and allows the fluid or debris to enter the subs 34. On the downstroke, the pressure equalizes and the valves close from their own weight.

Figure 8:
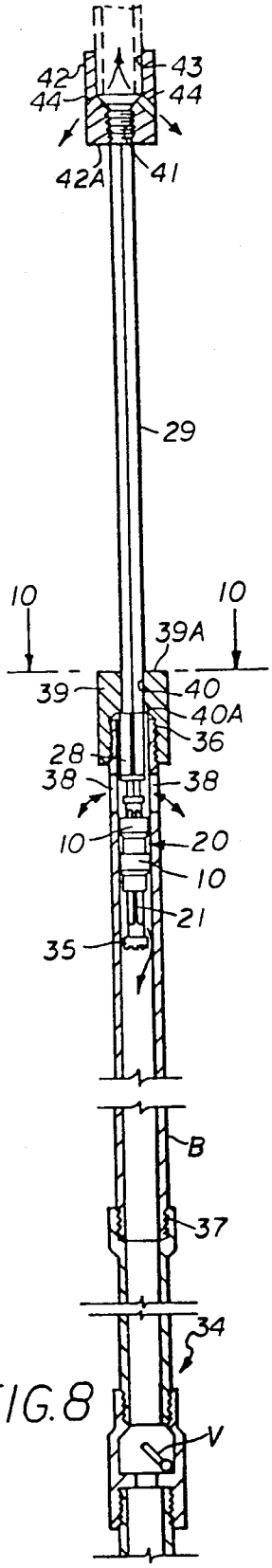
FIG. 8 is a side elevation of a portion of the well clean out tool in the extended position just prior to the down stroke.
Figure 10:
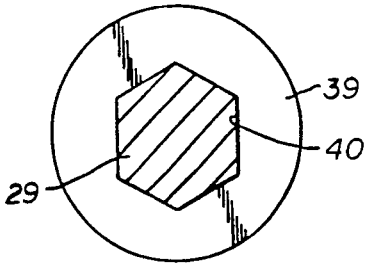
FIG. 10 is a transverse cross section through the pump mandrel taken along line 10—10 of FIG. 8.
Figure 9:
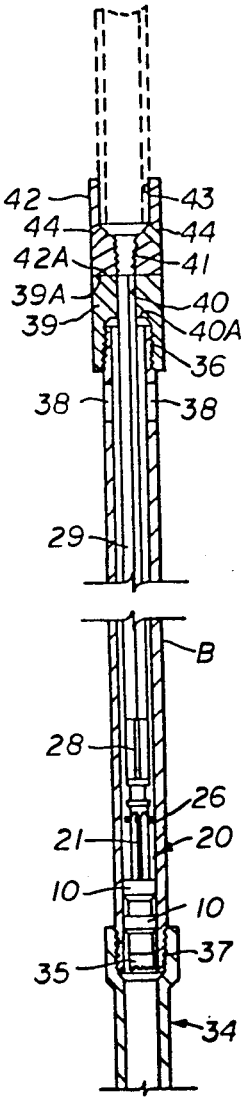
FIG. 9 is a side elevation of a portion of the well clean out tool in the contracted position just prior to the up stroke.

As shown somewhat schematically in FIGS. 8, 9, and 10, the elongate tubular pump barrel B has external threads 36 and 37 at the top and bottom ends. A series of circumferentially spaced ports 38 are formed through the side wall of the pump barrel B near the top end. The bottom end of the pump barrel B is threadedly received in the top of the upper saver sub 34. A top cap 39 has an internally threaded bottom and a hexagonal hole 40 in the top wall forming a shoulder 18A therebetween and is threadedly installed on the threaded top end of the pump barrel B.

The elongate hexagonal pump mandrel 29 is slidably received through the hexagonal hole 40 (FIG. 10) in the top of the top cap 39. The hexagonal pump mandrel 29 has external threads 41 at its bottom end. A top sub 42 having an internally threaded bottom end is threadedly received on the top end of the hexagonal pump mandrel 29. As seen in dotted line, the top end of the top sub 42 is internally threaded 43 to receive the bottom joint of a drill string which extends to the surface. A series of circumferentially spaced drain holes 44 ar formed through the side wall of the top sub 42 and extend angularly downward and outward from the interior to the exterior of the top sub.

The bottom surface 42A of the top sub 42 and the top surface 39A of the top cap 39 form opposed flat shoulders which may be brought forcefully together on the down stroke (FIG. 9) to force the penetrating device 35 into the sand and debris at the bottom of the well bore.

The swab assembly 20, previously described with reference to FIGS. 3-5, is slidably received within the pump barrel B. The hexagonal pump mandrel 29 extends through the top cap 39 and the knocker nut 28 threadedly connects the bottom end of the pump mandrel 29 to the swab bypass mandrel 21. The top surface of the knocker nut 28 may be forcefully brought into contact with the shoulder 40A in top cap 39 on the up stroke (FIG. 8) to jar the penetrating device 35 free from the sand and debris at the bottom of the well bore should it become stuck.

The preferred pump barrel is approximately between seven and eight feet in length, and additional joints of tubing may be installed between the pump barrel B and the saver subs 34 depending upon the fluid level in the well bore.

OPERATION

After the well clean out tool has been assembled, with one or more swab cups 10 on the bypass mandrel 21, the top sub 42 is installed on the tubing string, the apparatus is lowered into the well bore W until the pump barrel B is below the top surface of the column of fluid F. The apparatus may be lowered until the mule shoe sub, notched collar, drag bit, or mill 35 at the bottom of the apparatus reaches the sand or debris at the bottom of the well bore. The apparatus is in the extended position as it is lowered in the well bore and may be rotated as it is lowered or after reaching the sand or debris at the bottom of the well bore.

The hexagonal pump mandrel 29 extending through in the hexagonal hole 40 in the top cap 39 allows the assembly to be rotated as a complete unit. The assembly may be rotated by conventional means such as with power tongs, kelly, or power swivel. Rotating the apparatus will break up the sand and debris at the bottom of the well bore and allow it to be sucked into the saver subs more easily.

As shown in FIGS. 4 and 8, after the tool is fully extended and on the down stroke, the swab bypass mandrel 21 moves downward relative to the swab cups 10 and the swab cups are engaged by the mandrel upper stop shoulders 26. In this position, the bypass mandrel channels 22, the ports 38 at the top end of the pump barrel, and the ports 44 in the top sub 42, are all open and fluids circulate therethrough thus preventing hydraulic action of fluid inside the pump barrel.

As shown in FIGS. 5 and 9, when the tool is on the up stroke, the swab bypass mandrel 21 moves upward relative to the swab cups 10 and the top of the castle nut 33 at the bottom end of the swab bypass mandrel 21 engages the bottom of the lowermost swab cup 10. In this position, the lower portion 15 of the lowermost swab cup 10 is in a sealing relation on the exterior sealing surface 32 at the lower end of the bypass mandrel 21 below the channels 22 and the enlarged diameter upper portion 14 of the swab cup(s) will flex outwardly to form a reciprocal fluid sealing relation with the interior of the pump barrel B as the swab assembly is pulled upwardly through the fluid. As the swab assembly 20 is raised relative to the pump barrel B, fluids within the pump barrel are discharged or pumped out through the ports 38 at the top portion of the pump barrel.

The cleanout tool is operated by raising and lowering the tubing four to six feet, and on the up stroke, the flapper or check valves in the saver subs 34 open allowing sand and debris to enter the saver subs, and on the down stroke, the flapper or check valves close to capture the sand and debris inside the saver subs.

The bottom surface 42A of the top sub 42 and the top surface 39A of the top cap 39 may be brought forcefully together on the down stroke (FIG. 9) to force the penetrating device 35 into the sand and debris at the bottom of the well bore. The top surface of the knocker nut 28 may be forcefully brought into contact with the shoulder 40A in top cap 39 on the up stroke (FIG. 8) to jar the penetrating device 35 free from the sand and debris at the bottom of the well bore should it become stuck.

It should be noted that debris is not trapped in the pump portion, but in the subs and tubing run above and below the valves V. The amount of tubing used is determined by the estimated amount of debris believed to be in the well. In removing the debris, the working string is pulled from the well, the pump portion is unscrewed one joint at a time, allowing debris and fluid to fall out. Occasionally it may be necessary to strike the joint with a hammer to dislodge dryer, tightly packed debris. This is done until the entire debris trapping sub has been pulled and cleaned out, including the flapper valves V and any components that have been run below them, such as a mule shoe, notched collar, or drag bit.

While this invention has been described fully and completely with special emphasis upon a preferred embodiment, it should be understood that within the scope of the appended claims the invention may be practiced otherwise than as specifically described herein.

We claim:

1. A swab cup for use on a tubular swab material within a tubular pump barrel comprising:

a tubular metal sleeve having a longitudinal bore, a cylindrical outer body formed of flexible resilient material surrounding said metal sleeve and having an upper portion extending above the top end of said sleeve and a lower portion extending below the bottom end of said sleeve and having a central longitudinal bore coaxial with said sleeve longitudinal bore, said sleeve and said body central longitudinal bore open at each end to be slidably received on the exterior of a tubular swab mandrel, the interior of said outer body upper portion extending upward and outward above the top end of said sleeve, the exterior of said outer body having a first exterior diameter extending upwardly a distance from the bottom end, an intermediate portion extending angularly upward and outward therefrom and a second diameter larger than the first extending upwardly from the intermediate portion, and said outer body upper portion being sufficiently flexible to flex outwardly and form a sliding fluid sealing relation with the interior diameter of the pump barrel when pulled upwardly through a fluid and flex inwardly when pushed downwardly through a fluid to slide relative to the pump barrel interior diameter.

2. A swab assembly for use within a tubular pump barrel comprising:

a longitudinal swab bypass mandrel having a top end adapted for connection to a reciprocating member and having at least one longitudinal bypass channel on its circumference and axially spaced stop shoulders at each end of said bypass channel with a smooth cylindrical portion between the bottom end of said bypass channel and the lower stop shoulder, and at least one swab cup member having a tubular metal sleeve with a longitudinal bore and a cylindrical outer body formed of flexible resilient material surrounding said metal sleeve and having a central longitudinal bore coaxial with said sleeve longitudinal bore and said outer body having an upper portion extending above the top end of said sleeve and a lower portion extending below the bottom end of said sleeve and the exterior of the upper portion configured to form a sliding fluid sealing reaction with the interior surface of said pump barrel, said swab cup member slidably received and vertically movable on said bypass mandrel between an uppermost fluid bypass position a lowermost fluid lifting position, said mandrel upper stp shoulder forming a stop for said swab cup member in its uppermost position and said lower stop shoulder forming a stop for said swab cup member in its lowermost lifting position, said swab cup sleeve and body central longitudinal bores configured to allow fluid circulation through said mandrel bypass channel in its uppermost position and in its lowermost lifting position to form a fluid sealing relation with said bypass mandrel smooth cylindrical portion to close off circulation through said bypass channel, whereby on the down stroke said swab bypass mandrel will move downward relative to said swab cup member engaging it with the upper stop shoulder to allow passage of fluid through said bypass mandrel channel and on the up stroke, said swab bypass mandrel will move upward relative to said swab cup member to engage said swab cup member with the lower stop shoulder in a sealing relation with said bypass mandrel smooth cylindrical portion below the channel and said swab cup member exterior will form a sliding fluid sealing relation with said pump barrel interior surface.

3. A swab assembly according to claim 2 wherein;

said swab cup member comprises a cylindrical upwardly facing cup-shaped elastomeric member having an exterior diameter portion at its lower end spaced inwardly from the interior diameter of said pump barrel and an enlarged exterior diameter portion extending angularly upward and outward at its upper end to slidably engage the interior diameter of said pump barrel, and the upper end of said swab member being of sufficient thickness to flex outwardly to form a sliding fluid sealing relation with the interior diameter of said pump barrel on the up stroke an&k15H flex inwardly on the down stroke to slide relative to said pump barrel interior diameter.

4. A swab assembly for use within a tubular pump barrel comprising:

a solid longitudinal swab bypass mandrel having a top end adapted for connection to a reciprocating member and having a pair of radial flanges formed on its upper end which are spaced apart by a wrench flat portion, the mandrel having a cruciform cross section defining circumferentially spaced longitudinal fluid bypass channels separated by longitudinally extending ribs and axially spaced stop shoulders at each end of said bypass channels with a smooth cylindrical portion between the bottom end of said bypass channels and the lower stop shoulder, the longitudinal ribs having radial outward extensions a short distance below the lowermost radial flange to define the upper stop shoulder, at least one swab cup member slidable vertically on said bypass mandrel between an uppermost fluid bypass position and a lower most fluid lifting position, said mandrel upper stop shoulder forming a stop for said swab cup member in its uppermost position and said lower stop shoulder forming a stop for said swab cup member in its lowermost lifting position, said swab cup member having an interior diameter configured to allow fluid circulation through said mandrel bypass channel in its uppermost position and in its lowermost lifting position to form a fluid sealing relation with said bypass mandrel smooth cylindrical portion to close off circulation through said bypass channel and having an exterior diameter configured to form a sliding fluid sealing relation with the interior surface of said pump barrel, whereby on the down stroke said swab bypass mandrel will move downward relative to said swab cup member engaging it with the upper stop shoulder to allow passage of fluid through said bypass mandrel channel and on the up stroke, said swab bypass mandrel will move upward relative to said swab cup member to engage said swab cup member with the lower stop shoulder in a sealing relation with said bypass mandrel smooth cylindrical portion below the channel and said swab cup member exterior diameter will form a sliding fluid sealing relation with said pump barrel interior surface.

5. A swab assembly according to claim 4 wherein said swab bypass mandrel has external threads at its top end for threaded connected at its top end to the reciprocating member and external threads at its bottom end which terminate below the smooth cylindrical portion beneath said bypass channels, and said mandrel lower stop shoulder comprises a nut member threadedly received and removably secured on the threads at the bottom end of said bypass mandrel.

6. A swab assembly according to claim 5 wherein said swab cup member comprises a cylindrical upwardly facing cup-shaped elastomeric member having a central bore which is slidably carried on said swab bypass mandrel and having an exterior diameter portion at its lower end spaced inwardly from the interior diameter of said pump barrel and an enlarged exterior diameter portion extending angularly upward and outward at its upper end to slidably engage the interior diameter of said pump barrel, and the upper end of said swab member being of sufficient thickness to flex outwardly to form a sliding fluid sealing relation with the interior diameter of said pump barrel on the up stroke and flex inwardly on the down stroke to slide relative to said pump barrel interior diameter.

* * * * *